US007044826B2

(12) United States Patent
Edwards

(10) Patent No.: US 7,044,826 B2
(45) Date of Patent: May 16, 2006

(54) ROLL-ON-ROLL-OFF REMOTE CONTROL TRUCK

(76) Inventor: Robert Edwards, 427 Laurence Pkwy., South Amboy, NJ (US) 08879

( * ) Notice: Subject to any disclaimer, the term of this patent is extended or adjusted under 35 U.S.C. 154(b) by 0 days.

(21) Appl. No.: 10/858,196

(22) Filed: Jun. 1, 2004

(65) Prior Publication Data

US 2005/0266769 A1 Dec. 1, 2005

(51) Int. Cl.
*A63H 17/05* (2006.01)

(52) U.S. Cl. ..... 446/428; 446/454

(58) Field of Classification Search ..... 446/424–428, 446/454; 298/1 T; 280/828
See application file for complete search history.

(56) References Cited

U.S. PATENT DOCUMENTS 3,605,331 A * 9/1971 Linstead ..... 446/428
3,711,990 A * 1/1973 Pfeilsticker ..... 446/428
4,429,888 A * 2/1984 Wu ..... 280/828
4,696,517 A * 9/1987 Nagano ..... 298/1 T
4,889,515 A * 12/1989 Auer et al. ..... 446/428
5,435,768 A * 7/1995 Dunleavy ..... 446/427
6,110,003 A * 8/2000 Green ..... 446/428
6,264,528 B1 * 7/2001 Doan et al. ..... 446/424

* cited by examiner

*Primary Examiner*—Kien Nguyen
(74) *Attorney, Agent, or Firm*—Jaspan Schlesinger Hoffman LLP

(57) ABSTRACT

According to an embodiment of the present invention, there is provided a remotely operated toy truck for loading and unloading a roll-on-roll-off dumpster, the truck comprising: a dumpster system including a ramp for raising and lowering in relation to the truck, and a means for moving the dumpster between a loaded position on the ramp and an unloaded position off the ramp; and an electronic system for receiving one or more remote control signals and transmitting the one or more signals to the dumpster system to control the positioning of the ramp and the means to move the dumpster between the loaded position and the unloaded position. The truck further comprises a chassis and a vehicular drive system.

20 Claims, 16 Drawing Sheets

FIG. 8
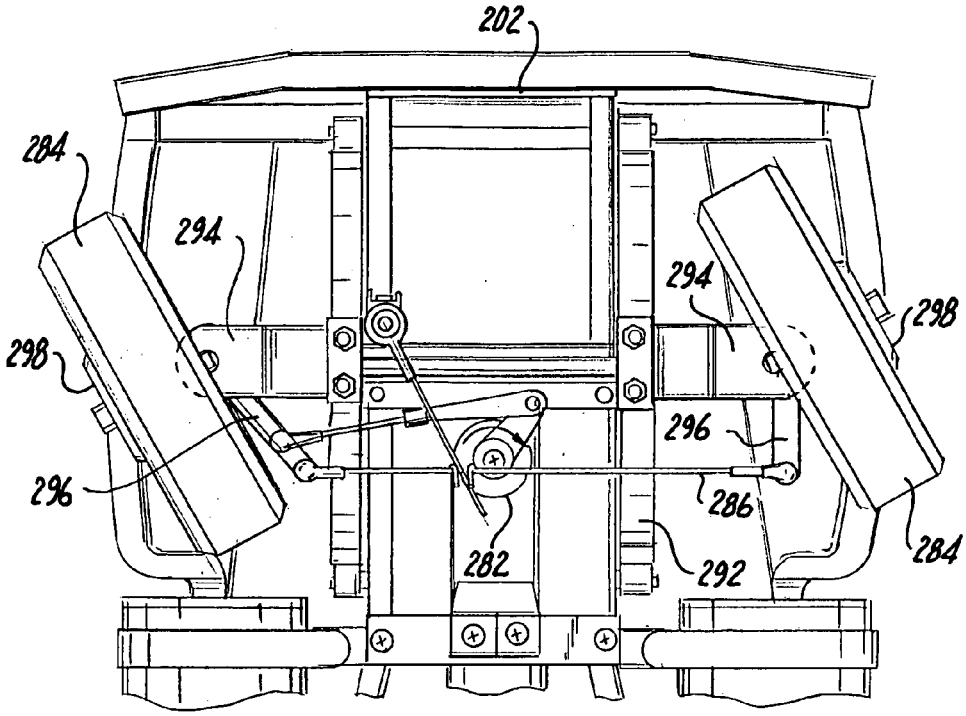
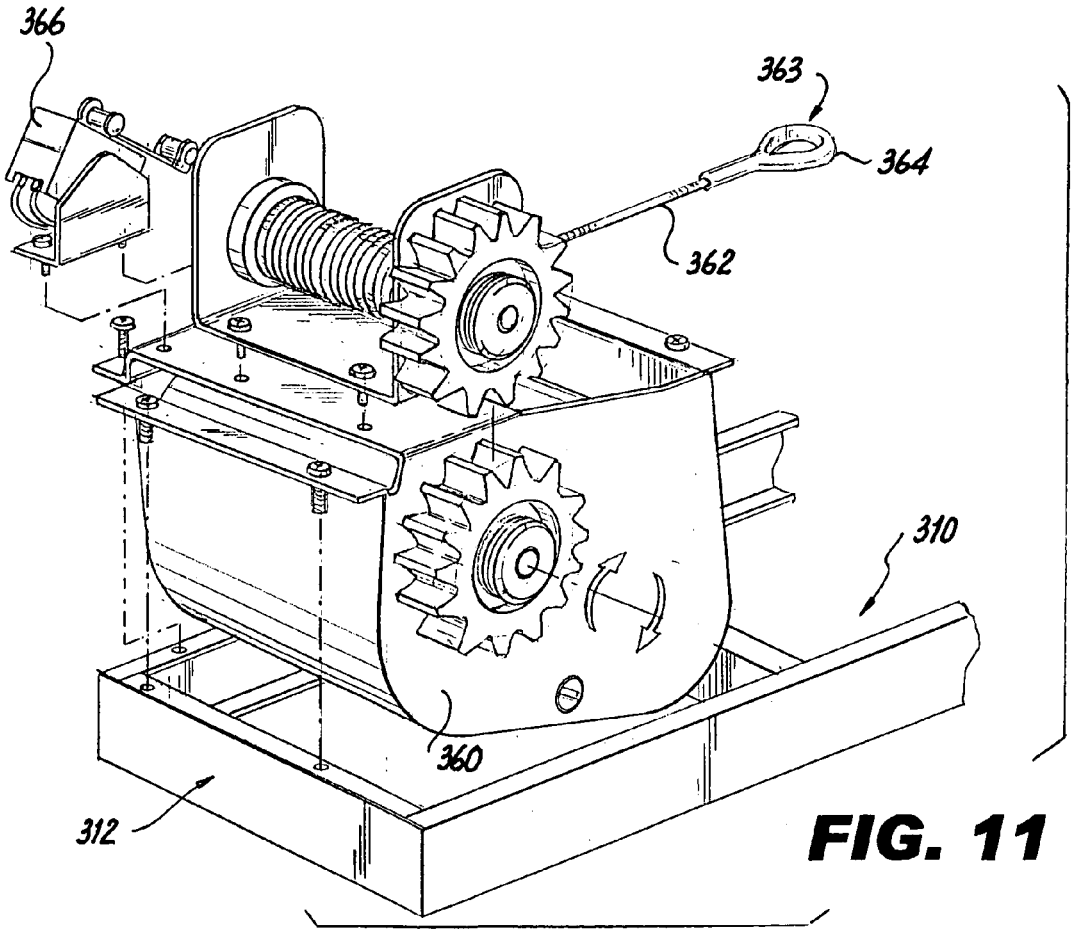
FIG. 11

ROLL-ON-ROLL-OFF REMOTE CONTROL TRUCK

BACKGROUND

1. Technical Field

The present invention generally relates to remote-control toy trucks. More particularly, the present invention is directed to a remote-control truck capable of being remotely operated to, among other operations, move a removable roll-on roll-off dumpster between a loaded position on the truck and an unloaded position off the truck.

2. Background of Related Art

Remote control toy trucks have a long history including trash hauling trucks and flat bed tow trucks. These remote control trucks have many systems in common with remote control ground vehicles including driven wheels, steering and ancillary systems. The driving mechanisms are typically electric motors actuated by servos, belts and gears. These trash hauling trucks have also included secondary systems for the lifting, inverting, and emptying of trash dumpsters into the trucks. The trash dumpsters are emptied vertically into the trash trucks and the dumpsters are returned to their approximate original position.

In U.S. Pat. No. 6,264,528 B1 to Doan et al., a remote controlled toy trash truck is described having a propulsion system and a pair of U-shaped dumpster lifting arms. The lifting arms extend forward of the cab and are connected to a pivotally mounted frame member. The lifting arms are configured to engage a dumpster, lift it over the cab, at least partially invert the dumpster, and dump the contents of the dumpster into the truck. Servo motors are employed to perform functions, such as moving the truck forwards and backwards, pivoting the lifting arms, opening the top or overhead door to receive the trash from the dumpster, and moving the trash holding dumpster between its resting position and its dumping position. The truck has a suspension system including shocks.

In U.S. Pat. No. 5,435,768 to Dunleavy, a remote control truck is described including a standard chassis and a pair of connected pivotal fork frames connected on opposing sides of the chassis. The fork frames engage, lift, and invert a dumpster, dumping the contents thereof into a top opening in the truck. The truck has a remotely controllable top opening and a rear door. The chassis is a commercially available product and suitable for use as a platform for forward and rear movement of the truck.

In U.S. Pat. No. 4,889,515 to Auer et al., a toy car having a motor is positioned on an unpowered toy flat bed tow truck. When properly positioned, the car drives the wheels of the truck through a system of gears that connect the axles of the car and the truck. The flat bed slides and pivots to make a ramp for the movement of the car between being positioned on the tow truck and the ground.

There exists a need in the art for a remote control roll-on roll-off toy truck suitable for use with a trash hauling dumpster capable of being remotely operated to move the dumpster between a loaded position on the truck and an unloaded position off the truck.

SUMMARY

According to an embodiment of the present invention, there is provided a remotely operated toy truck for loading and unloading a roll-on-roll-off dumpster, the truck comprising: a dumpster system including a ramp for raising and lowering in relation to the truck, and a means for moving the dumpster between a loaded position on the ramp and an unloaded position off the ramp; and an electronic system for receiving one or more remote control signals to control the positioning of the ramp and the means to move the dumpster between the loaded position and the unloaded position.

According to another embodiment of the present invention, there is provided a remotely operated toy truck for loading and unloading a roll-on-roll-off dumpster, the truck comprising: a chassis; a vehicular drive system disposed on the chassis and configured for moving the chassis on a plurality of tires; a dumpster system disposed on the chassis, the dumpster system including a ramp for raising and lowering in relation to the chassis, and a means for moving the dumpster between a loaded position on the ramp and an unloaded position off the ramp; and an electronic system for receiving a plurality of control signals to control the vehicular drive system and the dumpster system, the electronic system controlling positioning of the ramp and the means to move the dumpster between the loaded position and the unloaded position.

BRIEF DESCRIPTION OF THE DRAWINGS

The features and advantages of the present invention will become apparent to one skilled in the art, in view of the following detailed description in combination with the attached drawings, in which:

FIG. 8 is an exemplary illustration of bottom view of the front portion of the truck in FIG. 1, with the wheels in a right turn position, in accordance with the present invention;

FIG. 11 is an exemplary left perspective view of a winch positioned on a ramp of the truck in FIG. 1, in accordance with the present invention;

DETAILED DESCRIPTION OF THE PRESENT INVENTION

Referring now in specific detail to the drawings, like-referenced numerals identify similar or identical elements throughout the illustrated views.

Figure 1:
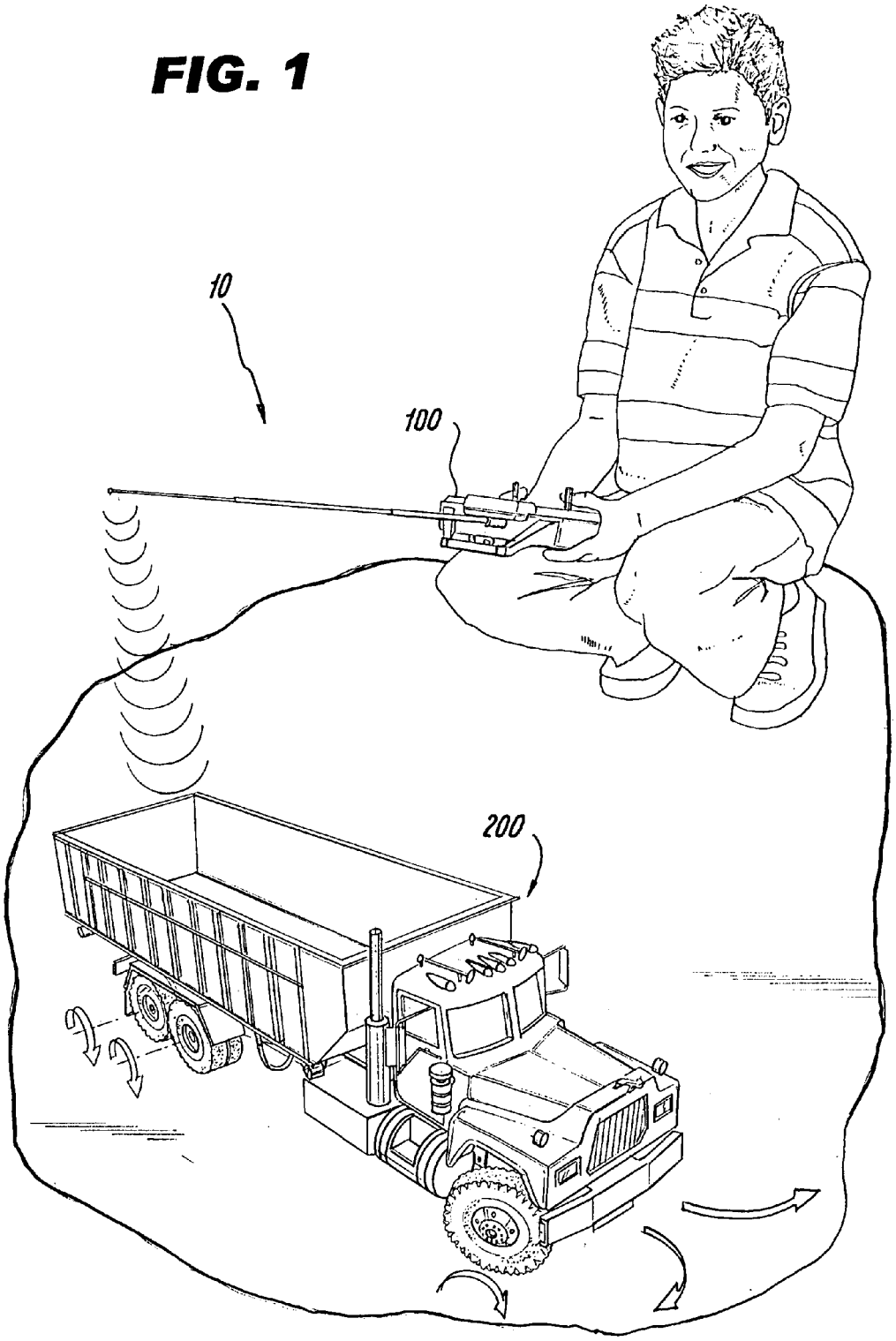
FIG. 1 is an exemplary illustration of a right front perspective view of a roll-on roll-off remote-control truck system, including a removable dumpster and a remote control device for operating the truck, in accordance with the present invention.

FIG. 1 illustrates an exemplary front perspective view of a roll-on roll-off remote control truck system 10 including a truck 200 and a remote control device 100 operated by a user. The remote control device 100 has controls suitable for remotely or wirelessly moving and activating the different systems of truck 200, as will be described herein. Remote control device 100 is preferably an off-the-shelf remote control device having additional functionality, as will be described herein. Remote control device 100 preferably uses radio frequency (RF) to transmit one or more control signals to remotely operate the truck 200. Other forms of remote or wireless transmission may be utilized and are considered to be within the scope of the present invention.

Figure 2:
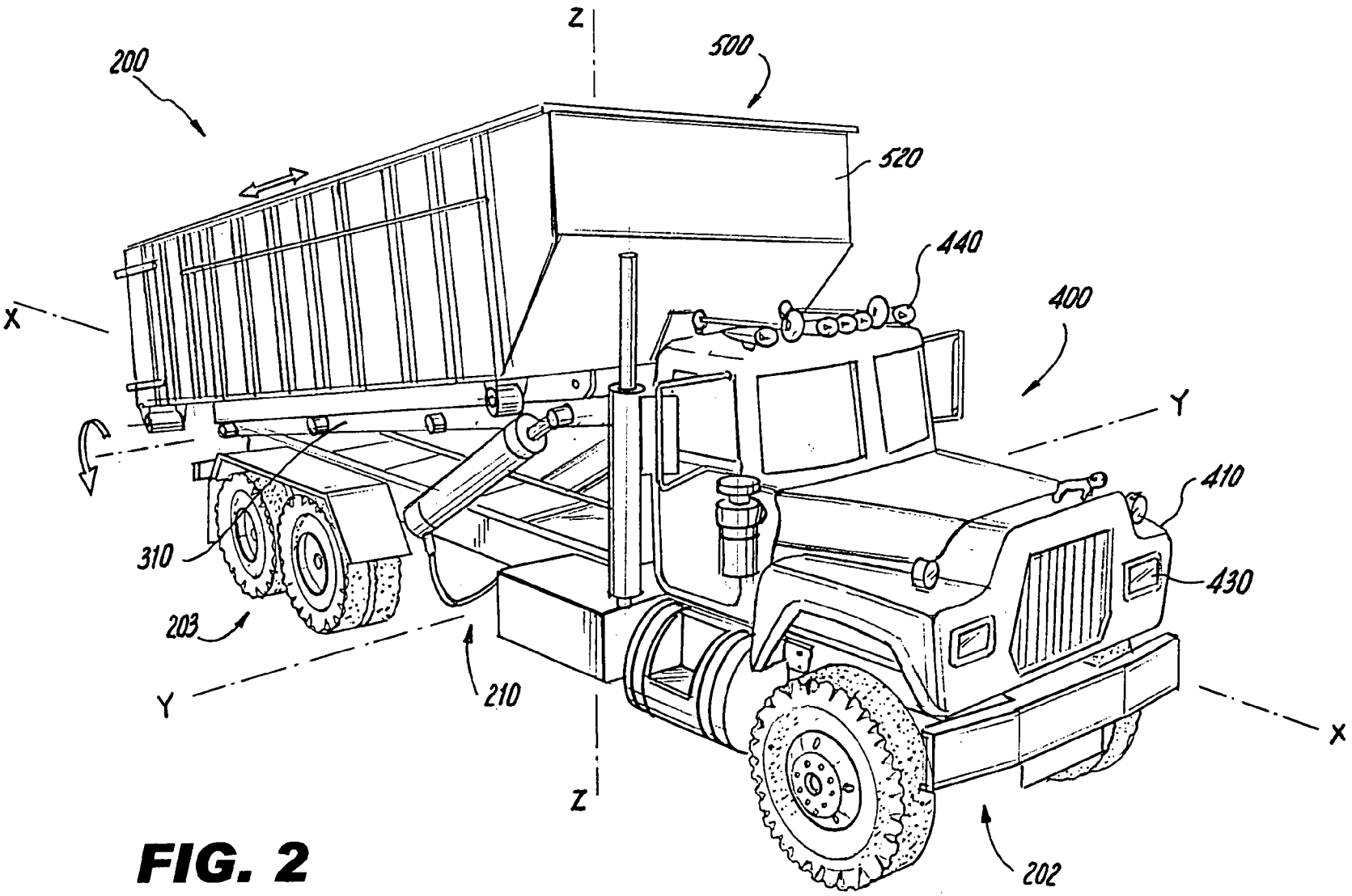
FIG. 2 is an exemplary illustration of right front perspective view of the truck in FIG. 1, with the removable dumpster partially elevated by a ramp of the truck, in accordance with the present invention.
Figure 3:
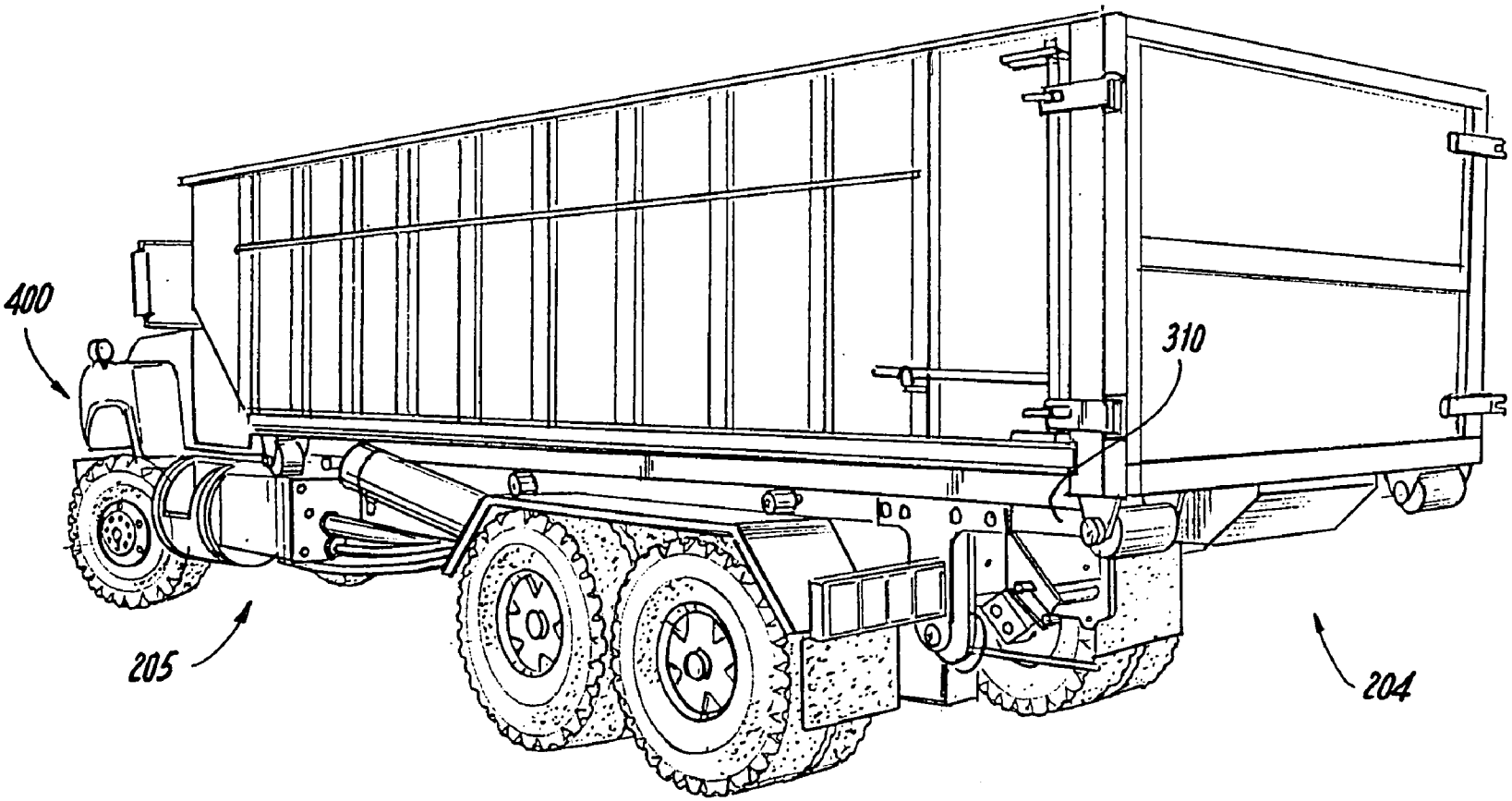
FIG. 3 is an exemplary illustration of left rear perspective view of the truck in FIG. 1, in accordance with the present invention.

As illustrated in FIGS. 2–3, truck 200 includes a chassis 210, a body 400, and a dumpster 500. Truck 200 has a forward end 202, a rear end 204, a right side 203, and a left side 205. Forward end 202 and rear end 204 define a central longitudinal axis-X. An axis-Y extends perpendicularly to the longitudinal axis-X and approximately through the center of truck 200. An axis-Z intersects and is perpendicular to axis-X and axis-Y. Truck 200 is positioned on a surface generally parallel to the plane formed by axis-X and axis-Y.

Figure 4:
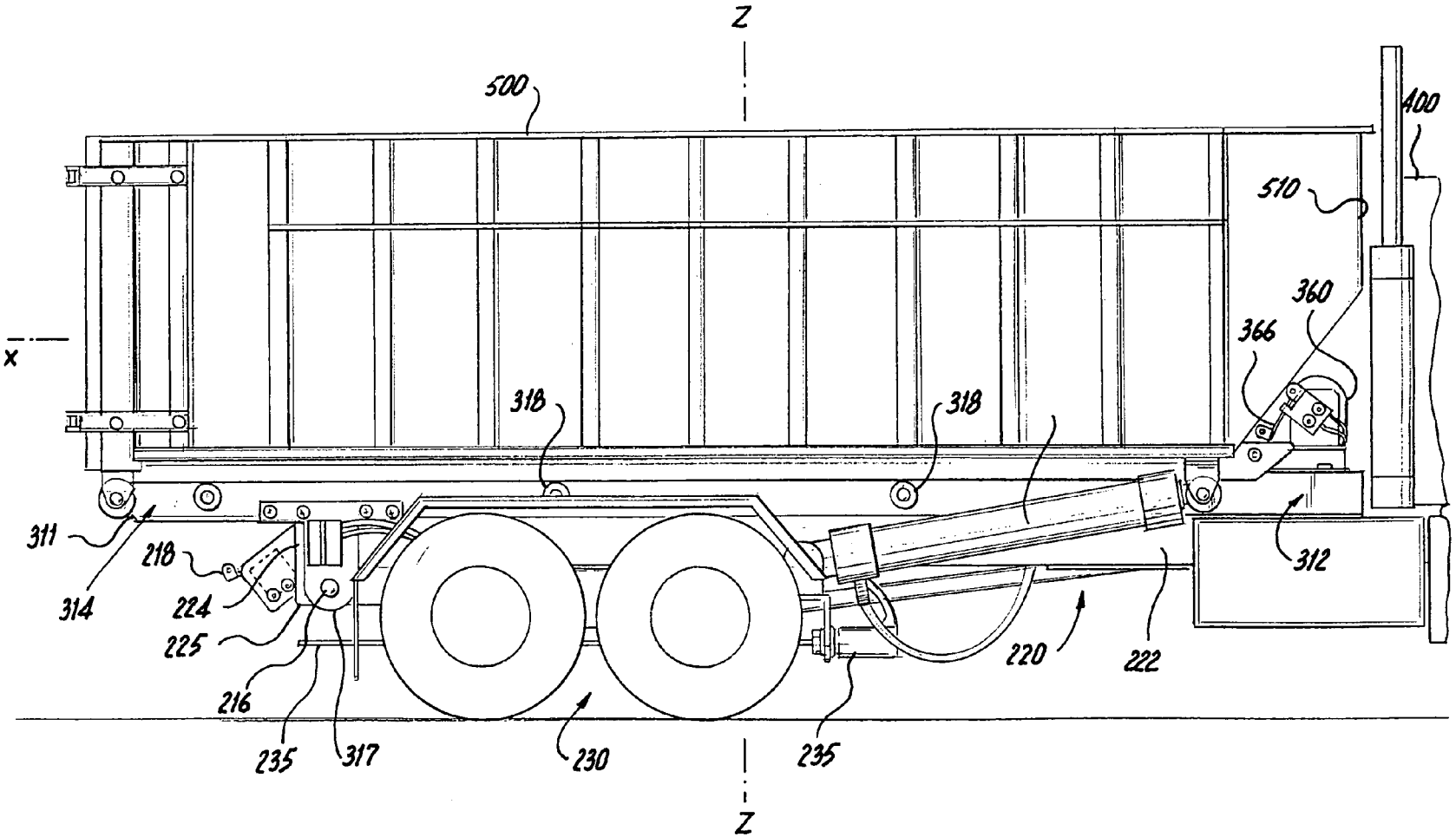
FIG. 4 is an exemplary illustration of right side view of a rear portion of the truck in FIG. 1, in accordance with the present invention.
Figure 5:
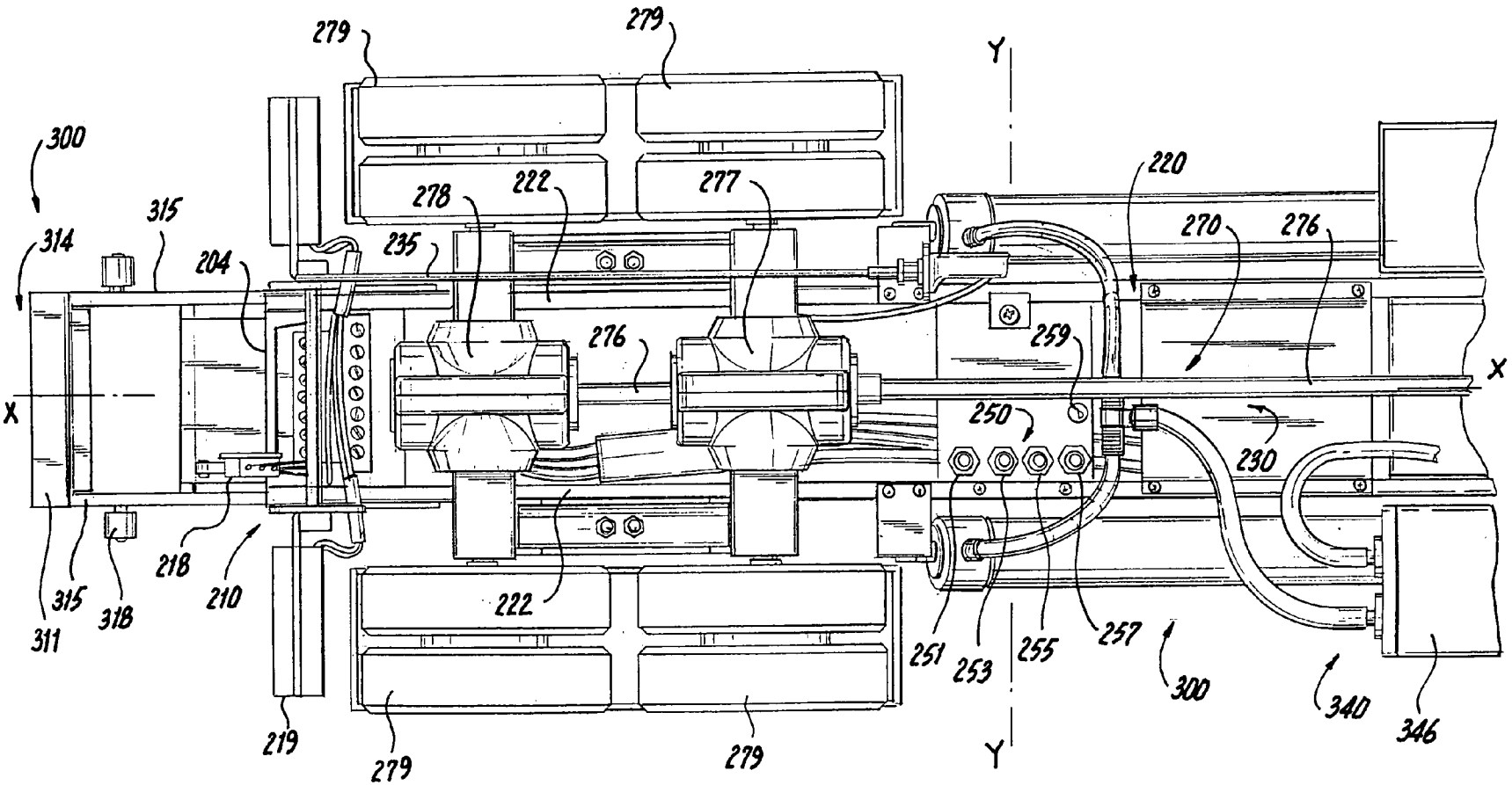
FIG. 5 is an exemplary illustration of bottom view of a rear portion of the truck in FIG. 4, the dumpster being displaced from the truck, in accordance with the present invention.
Figure 6:
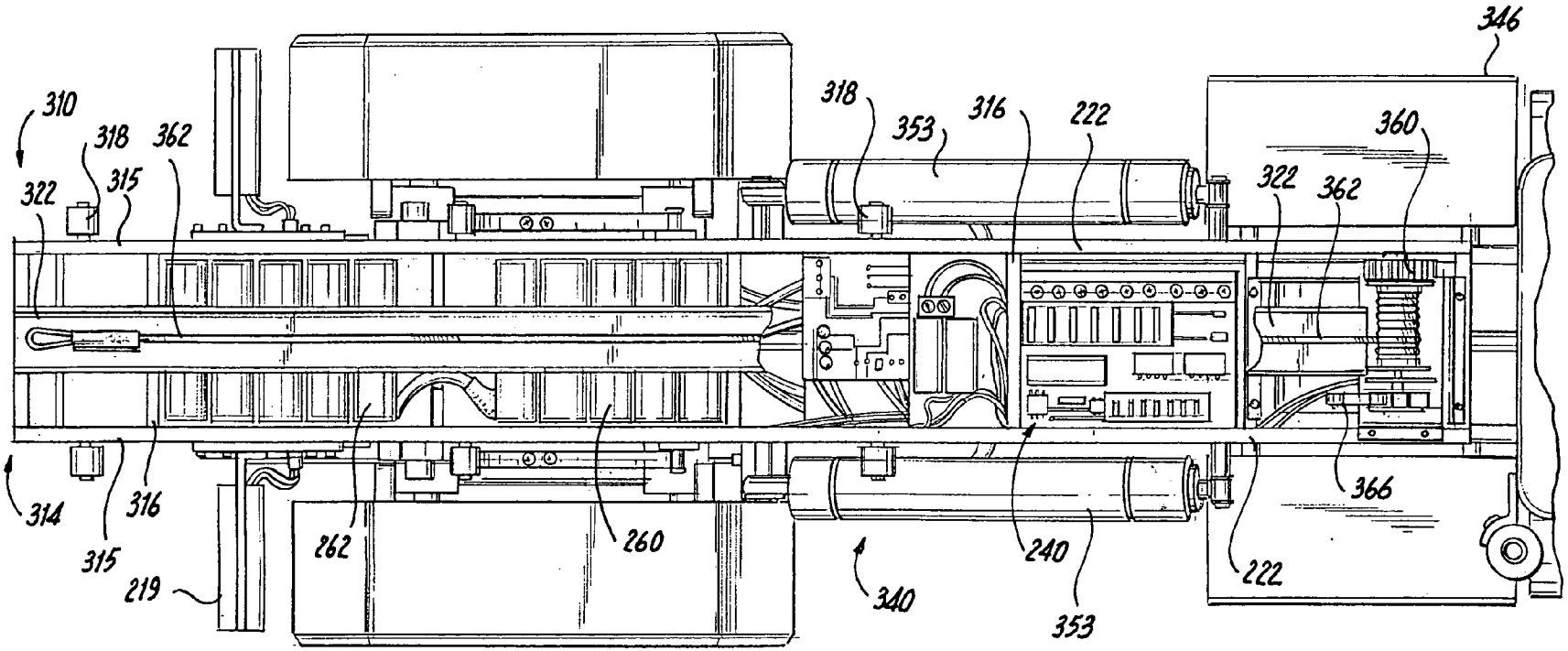
FIG. 6 is an exemplary illustration of top view of the truck in FIG. 4, the dumpster being displaced from the truck, in accordance with the present invention.

As illustrated in FIGS. 4–6, chassis 210 includes a frame 220, a vehicular drive system 230, an electronics systems 240 and a dumpster system 300. Vehicular drive system 230 provides functions for truck 200 in combination with electronics system 240, such as but not limited to the forward movement, reverse movement, steering, and engine-like sounds.

Figure 7:
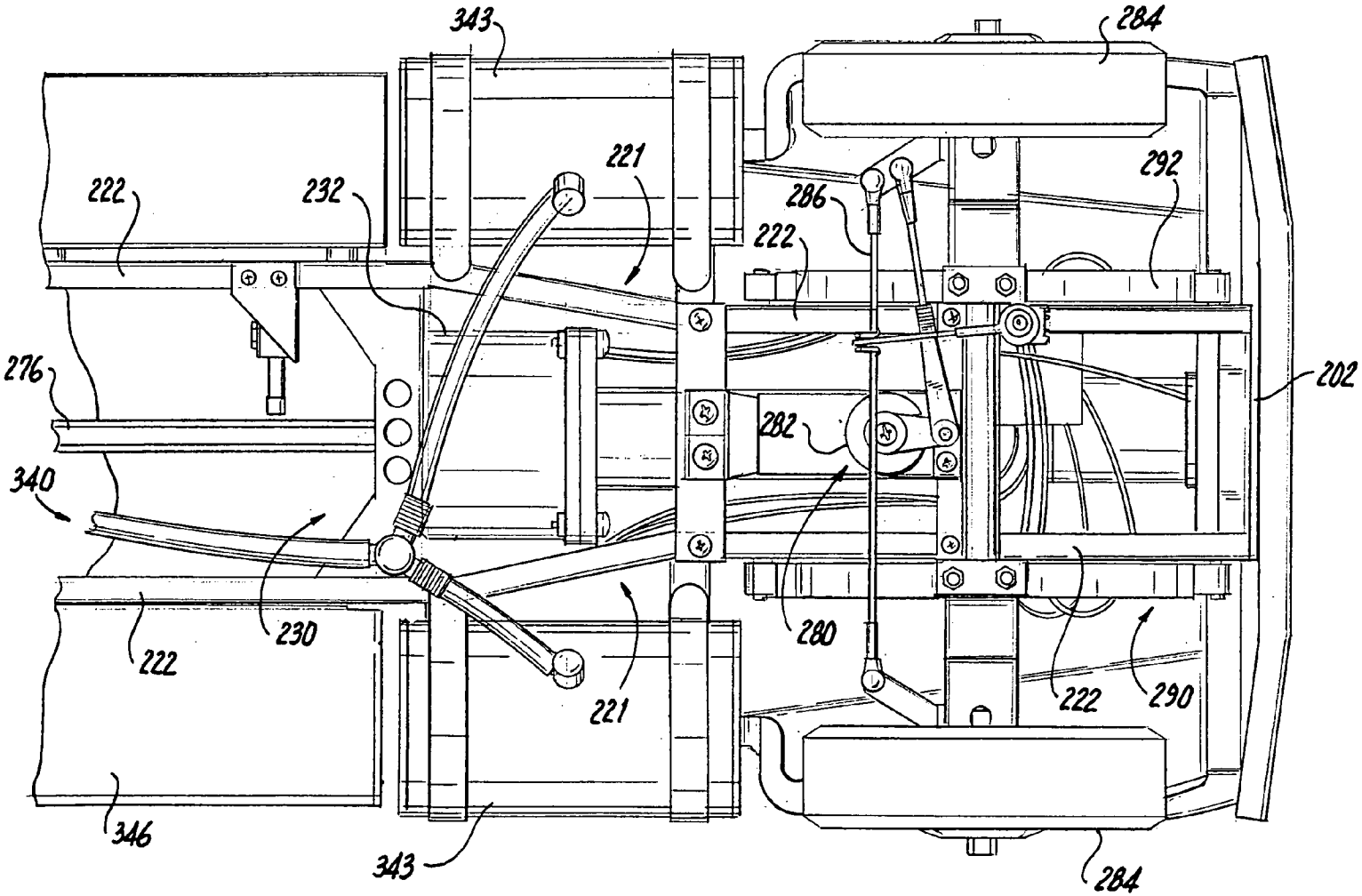
FIG. 7 is an exemplary illustration of bottom view of a front portion of the truck in FIG. 1, the dumpster being displaced from the truck, in accordance with the present invention.

Frame 220 has two beams 222 running generally parallel to axis-X providing a framework for structurally supporting the systems such as but not limited to the vehicular drive system 230, the dumpster system 300 and body 400. Frame 220 can be an existing structural frame or one specifically designed for this application. Frame 220 may have one or more tapered portions, where the distance between beams 222 may vary. For example, as illustrated in FIG. 7, beams 222 of frame 220 taper at portion 221. Frame 220 is connected with a front bumper on forward end 202 and a rear bumper on a rear end 204 (See FIGS, 2–3). A flanged portion 225 is positioned in the vicinity of rear end 224 and defines a through hole 226 (See FIG. 10). An axle 216 parallel with axis-Y extends through holes 226 and outward from flanges 225 of beams 222. Rear end 204 also includes a limit switch 218.

Referring now to FIGS. 5–7, vehicular drive system 230 provides the power, direction, and control for the systems of truck 200. Vehicular drive system 230 includes a vehicular drive train 270 and a motor 232. Motor 232 is preferably on electric motor which simulates a standard internal combustion engine and transmission. In this one preferred embodiment, motor 232 for truck 200 is positioned forward under body 400 and structurally connected to frame 220. It is understood, however, motor 232 can be located at a plurality of positions on frame 220. Vehicular drive system 230 is coupled with electronics system 240.

Electronics system 240 includes communications means, a power source 260, a light system, a sound system and a control system 250. Communications means is suitable for supporting RF communications between truck 200 and remote control device 100. Electronics system 240 is integrated with electrical devices such as motors, pumps, and servos of vehicular drive system 230 and dumpster system 300. Electronics system 240 is connected to frame 220.

Communications means includes an antenna 235, amplifier, transmitter, and receiver. In this embodiment, antenna 235 is coupled with the amplifier, transmitter, receiver, and controls 250. Antenna 235, the transmitter, and the receiver are mounted to frame 220. Communication means is configured for RF coupling with remote control device 100 and is suitable for being mounted on any portion of truck 200.

The light system distributes electrical power to the lights on truck 200 including those positioned on body 400 and tail lights 219. The lights can be traditional incandescent lights, LEDs and the like.

The sound system is positioned on chassis 210 and includes an amplifier, recorded sound, and speakers. The sound system is preferably actuated from remote control device 100 (See FIG. 1), but it can also include manual controls from truck 200. The emitted sounds include truck related engine and horn sounds. The speakers are supported by or integrated into body 400.

Electronic system 240 has a source of power or power source 260 for supplying the energy needed to sustain the operations of truck 200. Power source 260 preferably includes one or more batteries 262, which are preferably rechargeable. In this regard, power source 260 can include a connector suitable for connection with a battery recharger to recharge the one or more batteries 262. Alternatively, the batteries 262 may be disposable. Power source 260 also provides a source of power through electronic system 240 to other systems including, but not limited to, vehicular drive system 230, dumpster system 300, and body 400. Power source 260 is mounted to chassis 210.

Controls 250 are positioned on the bottom of frame 220 and are connected to electronic system 240. Controls 250 comprises a plurality of switches for truck 200, including a main switch 251 configured for connecting power source 260 with electronic system 240. A radio switch 253 connects communication means including preferably a radio having an amplifier, receiver, transmitter, and antenna 235 with power source 260. Additional switches include lights 255 and hazard lights 257. A power "on" light switch 259 provides indication of power in electronic system 240. Controls 250 may also include switches for the actuation of dumpster system 300. Some or all of controls 250 may also be positioned on remote control device 100. Alternatively, controls 250 may include at least some of the switches positioned on remote control device 100.

Vehicular drive train 270 includes a drive shaft 276, a pair of universal joints 277 and 278, a steering system 280, and a suspension system 290. A first portion of drive shaft 276 extends from motor 232 to a first universal joint 277. A second portion of the drive shaft 276 extends between a second universal joint 278 and first universal joint 277. The eight rear tires 279 are configured as two opposing pairs of dual mounted tires 279 independently driven by separate axles extending from universal joints 277, 278. Each pair of rear tires 279 spin independently. Universal joints 277 and 278 extend generally perpendicularly to longitudinal axis-X and at least partially enclose the axles for each of the pairs of rear tires 279. Motor 232 has suitable power from power source 260 for the operation of vehicular drive train 270.

Figure 9:
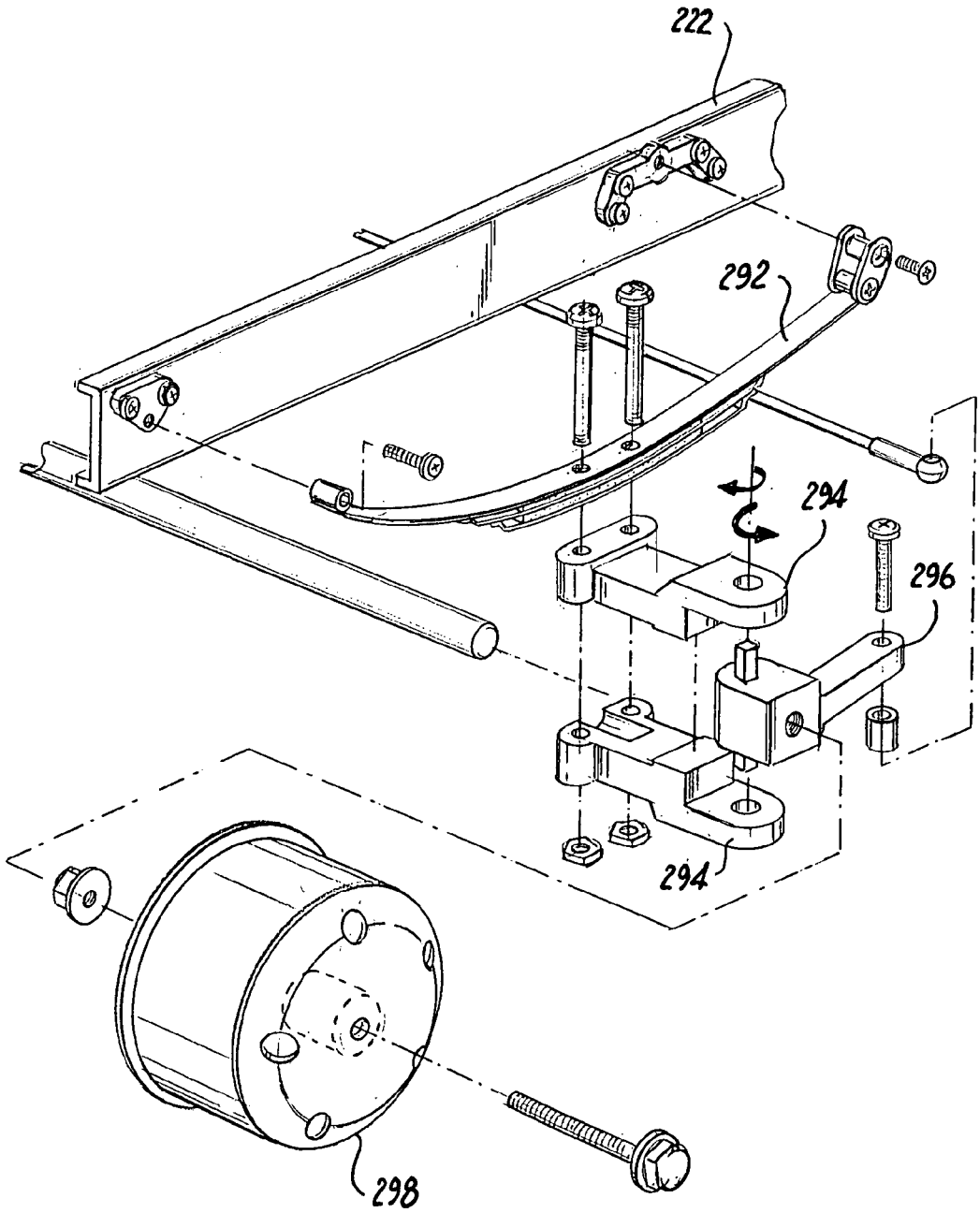
FIG. 9 is an exemplary exploded view of a suspension system of a right front wheel of the truck in FIG. 1, in accordance with the present invention.

As shown in FIGS. 7–9, electronic system 240 provides signals for the control and powering of steering system 280. Steering system 280 is preferably a standard commercial system includes a servo 282 driving the angular position of one of two front wheels 284. A tie rod 286 connects, aligns, and coordinates the steering of wheels 284. Wheels 284 are configured to spin independently. Steering system 280 may be configured in any manner suitable for performing its steering functions for truck 200.

Further referring to FIGS. 7–9, suspension system 290 comprises four leaf spring systems 292 connected to frame 220 and configured to accommodate terrain variations. Each front wheel leaf spring 292 is connected to a pair brackets 294 configured for retaining a rotating member 296. Member 296 has a pair of axles generally aligned with axis-Y and an arm 297 suitable for connecting to tie rod 286. Suspension system 290 and steering system 280 are connected by a system of fasteners such as bolts, with nuts providing a suitable range of motion for their application. Suspension system 290 can have any configuration suitable for use as a roll-on roll-off truck.

Figure 10:
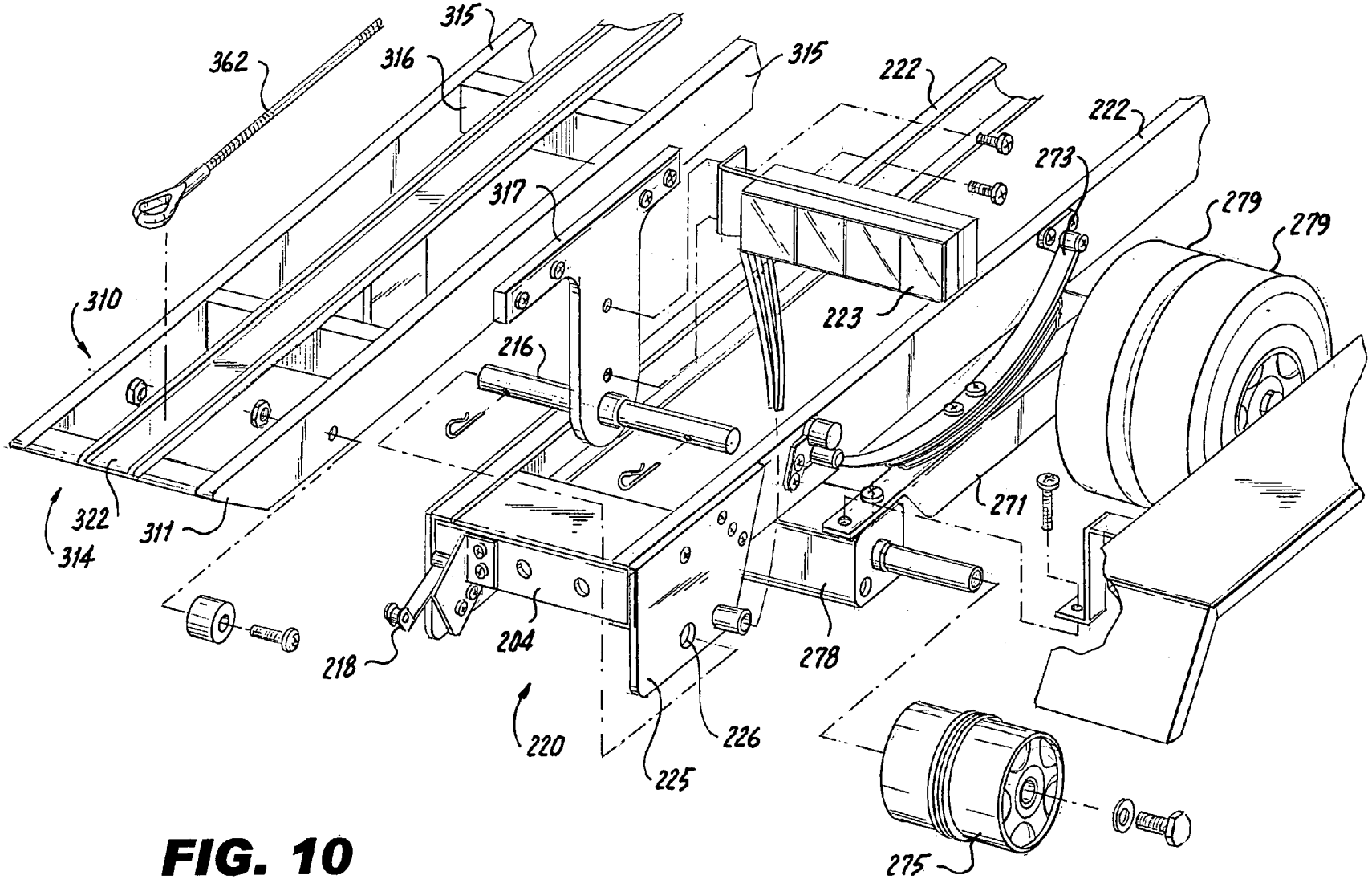
FIG. 10 is an exemplary exploded view of a suspension system of a right rear wheel of the truck in FIG. 1, in accordance with the present invention.

As shown in FIG. 10, rear tires are positioned as a set of two opposing pairs of driven dual mounted tires 279. Each pair of dual mounted tires 279 is positioned on dual hubs 275 and connected to its respective universal joint 277, 278. Universal joints 277 and 278 are connected by a pair of bars 271, with each bar being positioned on opposite each sides of frame 220 parallel to axis-X. Each bar 271 is connected to a rear leaf spring 273. The terminal ends of leaf springs 273 are connected to frame 220.

As shown in FIGS. 4–7, dumpster system 300 includes a ramp 310, a lifting mechanism 340, and a winch 360. Dumpster system 300 is configured to support loading dumpster 500, onto truck 202, fix dumpster 500 in position on the truck 200, unload dumpster 500 off the truck 200, and assist in the coupling and decoupling of dumpster 500 from truck 200. Dumpster system 300 is connected to frame 220 and is coupled with vehicular drive system 230.

Ramp 310 has a forward end portion 312 and a rear end portion 314. Ramp 310 has two rails 315 generally parallel with longitudinal axis-X and a plurality of cross members 316 connecting rails 315. Rails 315 also include flanges 317 extending parallel to a plane defined by axes X–Z and in a apposition with frame 220. Flanges 317 define through holes 316 parallel to axis-Y. Axle 216, parallel with axis-Y extends through holes 226, 316 and outward from flanges 225, 317 of beams 222 and rail 315, respectively. Ramp 310 pivots about axle 216.

Ramp 310 in a first position is at the bottom of its range of movement, generally parallel to frame 220, and is approximately abutting frame 220. In a second position ramp 310 forward end 312 is elevated and rear end 314 is positioned in proximity to the ground or surface such that dumpster 500 can be easily loaded and unloaded. Preferably, dumpster 500 is rolled-on and rolled-off ramp 310 for loading and unloading. The range of motion between the first position and second position of ramp 310 is preferably between about 30 degrees and about 60 degrees. Furthermore, the range of motion may vary outside the preferable range depending on design of components of truck 200, and is considered within scope of the present invention.

Rails 315 include a plurality of rollers 318 positioned on the outer sides of rails 315 and aligned for contacting and supporting dumpster 500. Rollers 318 have an axis of rotation parallel with axis-Y and are structured and positioned to support the static and dynamic loading from a loaded dumpster 500 as it loaded onto or unloaded off ramp 310 of truck 200. In one preferred embodiment four rollers 318 are positioned on each outer side of rails 315. The furthermost forward rollers 318 are positioned in the general vicinity of ramp 310. Forward end 312 also provides a structural connection with ramp 310 for pistons 353 of lifting mechanism 340. Each of rollers 318 in the vicinity of ramp 310 forward end 312 may be a simple cylindrical bar with or without any roller 318 that functions as a structural support and glide for dumpster 500.

Ramp 310 includes a channel 322 positioned on ramp 310 and generally aligned with axis X. Channel 322 is configured for the receiving and guiding cable 362 as it is retracted and extended from winch 360. Channel 322 guides and supports cable 362 from winch 360 to end 314. Channel 322 is positioned and configured to assist in supporting cable 362 during the coupling and uncoupling of dumpster 500.

Frame 220 includes a first limit switch positioned on chassis 220 and configured to be in apposition with ramp 310 in the first position. The first limit switch is coupled with lifting mechanism 340 of dumpster system 300 to stop the downward pivotal movement of ramp 310 as it approaches or contacts frame 220.

Rear end 204 includes a second ramp limit switch 218 positioned such that the pivotal movement downward of rear 314 of ramp 310 will contact and depress limit switch 218. Limit switch 218 is coupled with lifting mechanism 340 of dumpster system 300 to stop the elevating pivotal movement of ramp 310. Rear end 314 has a tapered edge 311 that extends rearward from frame 220. Ramp 310 is pivotally connected to frame 220 in the vicinity of rear 204. This maximum elevated position of ramp 310, approximately positions tapered edge 311 in close proximity to and parallel with the ground. Tapered edge 311 of end 314 is configured such that the upper surface of ramp 310 can be close proximity to the ground and thereby provide a relatively smooth transition between the surface and ramp 310 for dumpster 500. Tail lights 219 are connected to rear end 204 and coupled with electronic system 240.

Lifting mechanism 340 provides the means for raising and lowering ramp 310. Lifting mechanism 340 is preferably a fluid-based system configured for pivoting ramp 310 about the vicinity of rear 204 and is coupled with drive system 230. Lifting mechanism 340 has two reservoirs 343 positioned on opposing sides of frame 220. Reservoirs 343 preferably have the external appearance of fuel tanks for truck 200. Reservoirs 343 are connected to a pump 346 configured for providing fluid under pressure to pistons or hydraulic cylinders 353. Pump 346 is preferably positioned in an enclosure in the vicinity of reservoirs 343. Pistons 353 are positioned on opposing sides of truck 200 and connected to the outer sides of rails 312 and beams 222. Lifting mechanism 340 can be powered by power system 260 or motor 232.

Pump 346 provides fluid under pressure to move pistons 353 between the first position and the second position of ramp 310. Pump 346 is preferably an electrical pump and is coupled with electronic system 240. Pump 346 can fix ramp 310 in any position between the first and second positions by supplying pressure to pistons 353. More specifically, reducing the pressure to pistons 353 lowers forward end 312 of ramp 310, increasing the pressure to pistons 353 elevates forward end 312 of ramp 310. Reservoirs 343 have sufficient volume to provide and/or receive fluids for the movement of ramp 310 between the first and second positions.

Lifting mechanism 340 is preferably a fluid-based system wherein the hydraulic cylinders 353 directly drive ramp 310, but lifting mechanism 340 is understood as including any type of actuation system suitable for the lifting and lowering of ramp 310 for the loading and unloading of dumpster 500. Suitable actuation systems include, but are not limited to mechanical or electro-mechanical systems having servos, gears, belts, levers, and other configurations of drive mechanisms suitable for moving ramp 310 between the first and second positions.

Figure 19:
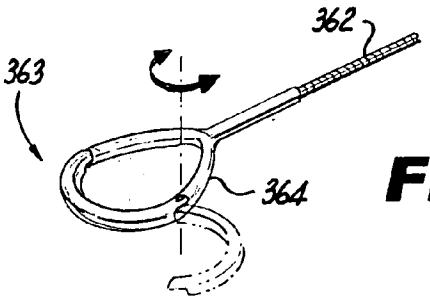
FIG. 19 is an exemplary close up view of a second configuration of a terminal end of the cable including a loop having an open and a closed position.
Figure 18:
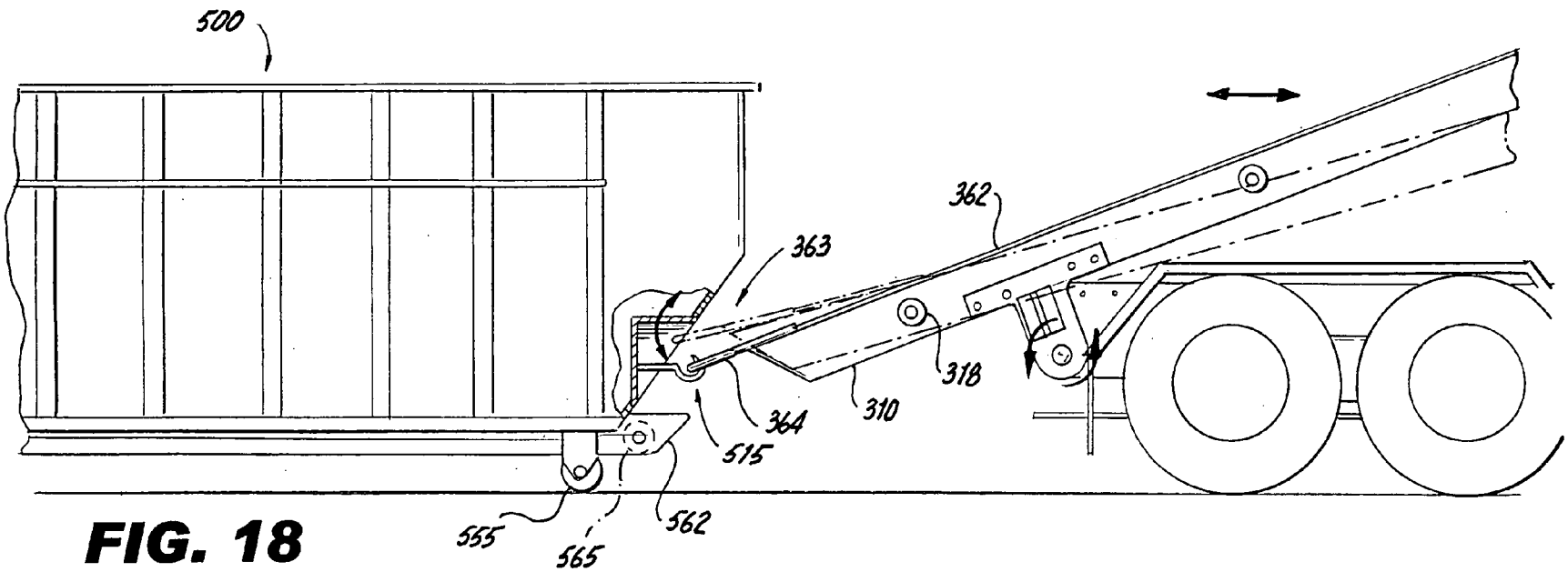
FIG. 18 is an exemplary side view of the truck having the terminal end of the cable positioned to the winch for being remotely disconnected from the dumpster, and in accordance with the present invention.

As shown in FIGS. 4, 6 and 11, winch 360 provides the means for loading, fixing in position, connecting, disconnecting, and unloading dumpster 500 and is preferably positioned on forward end 312 of ramp 310. Winch 360 is coupled with electronic system 240 and can be activated by remote control 100. Winch 360 includes a spooled cable 362 having a terminal end portion 363. Cable 362 may be fabricated of materials such as, but not limited to natural, synthetic, metal having suitable strength for applications with a loaded dumpster 500. Terminal end portion 363 is configured for connecting with dumpster 500 and has similarly suitable strength for applications with loaded dumpster 500. Configurations of terminal end portion 363 include connectors such as a cable loop or hook. Terminal end portion 363 can include a bar or rod connected to cable end 364 such that terminal end portion 363 is rigid or semi-rigid. Additional configurations include terminal end portion 363 being a member rigidly reinforcing a length of cable comprising terminal end portion 363. Terminal end portion 363 is sufficiently rigid such that at least a portion of terminal end portion 363 is suitable for being positioned as a cantilevered member extending out from channel 322 and beyond ramp end 314. In one preferred embodiment, end portion 363 preferably defines a through hole configured for receiving connector 515 positioned on dumpster 500 (See FIGS. 18 and 19).

Terminal end portion 363 can include a terminal end connector 364 for connecting to and disconnecting from connector 515. For example, terminal end connector 364 can include a lock mechanism opened and closed by microswitches, by direct contact with dumpster 500 or remotely using remote control 100 (See FIG. 19).

Limit switch 366 is positioned in the vicinity of forward end 312 and is coupled with drive system 230. Limit switch 366 is positioned such that when dumpster 500 is being loaded by the pulling force of cable 362 and hook 364 of winch 360, dumpster 500 will impact and depress limit switch 366 (See FIG. 4). The depressing of limit switch 366 by dumpster 500 ceases the pulling force of winch 360 and thereby halts the forward movement of dumpster 500 onto ramp 310.

It is understood, winch 360, as defined herein, includes alternate systems for loading dumpster 500 such as conveyer belt systems, gear systems, drive wheel systems, as well as others suitable for fixing the position of, loading, connecting, disconnecting, and unloading dumpster 500. Additionally, for example, winch 360 is described as positioned on ramp 310, but winch 360 could at least partially mounted on chassis 210 or dumpster 500.

As shown in FIGS. 1–2, body 400 includes a cab 410, headlights 430, and hazard lights 440. Cab 410 is a housing or partial enclosure connected to frame 220. Cab 410 is configured to appear as a model replica of a truck cab and includes a pair of opposing doors, door windows, door handles, and a windshield. Connected to cab 410 are peripherals such as, but not limited to a muffler, an air filter, turn signals, movable mirrors, a grill, horns, lights 430, and hazard lights 440. Cab 410 is preferably made of metal or metal alloy, but it can be fabricated of one or more materials such as a plastic, fiberglass, composite, or wood.

Figure 12:
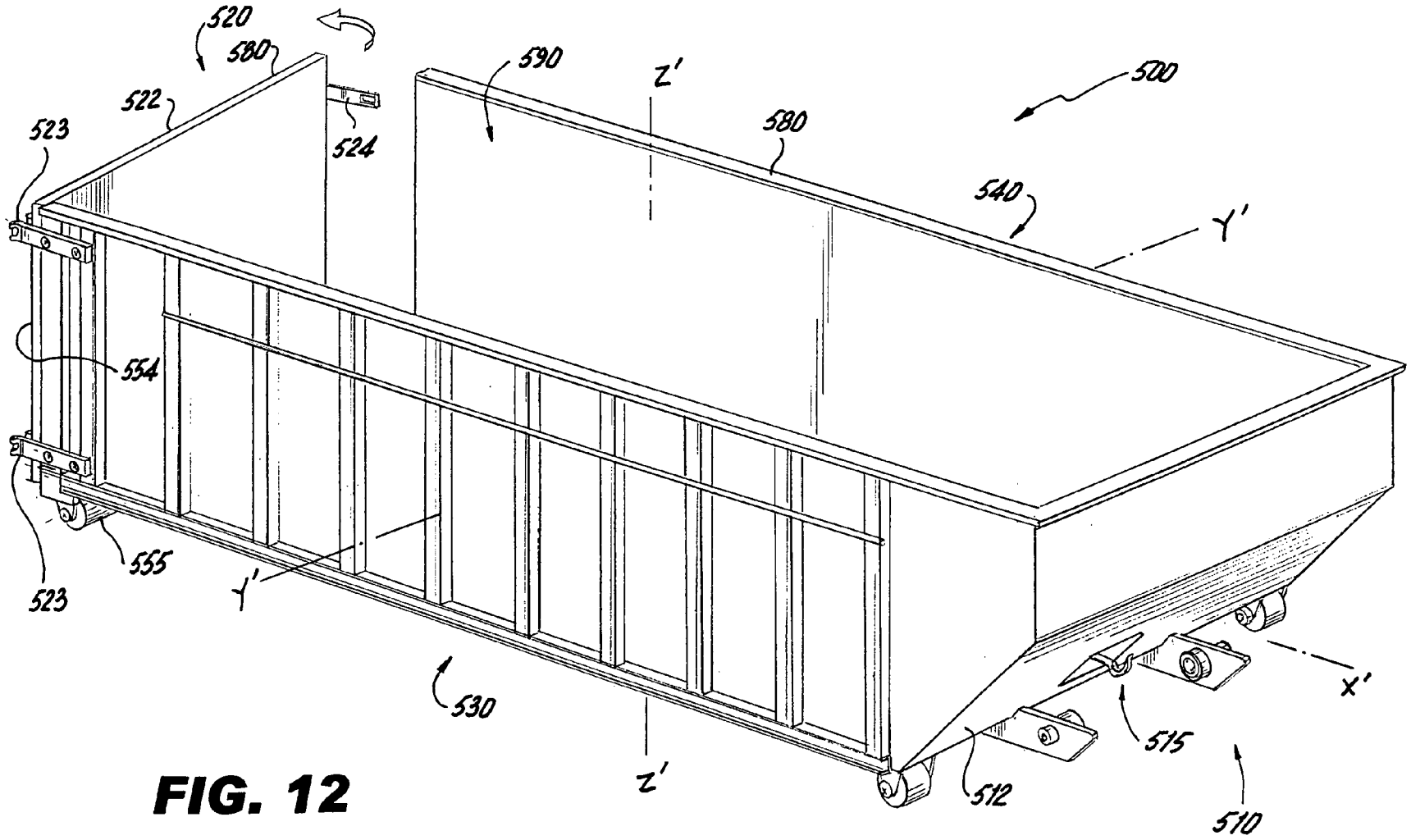
FIG. 12 is an exemplary right front perspective view of the dumpster in FIG. 1 with a rear door open, in accordance with the present invention.
Figure 13:
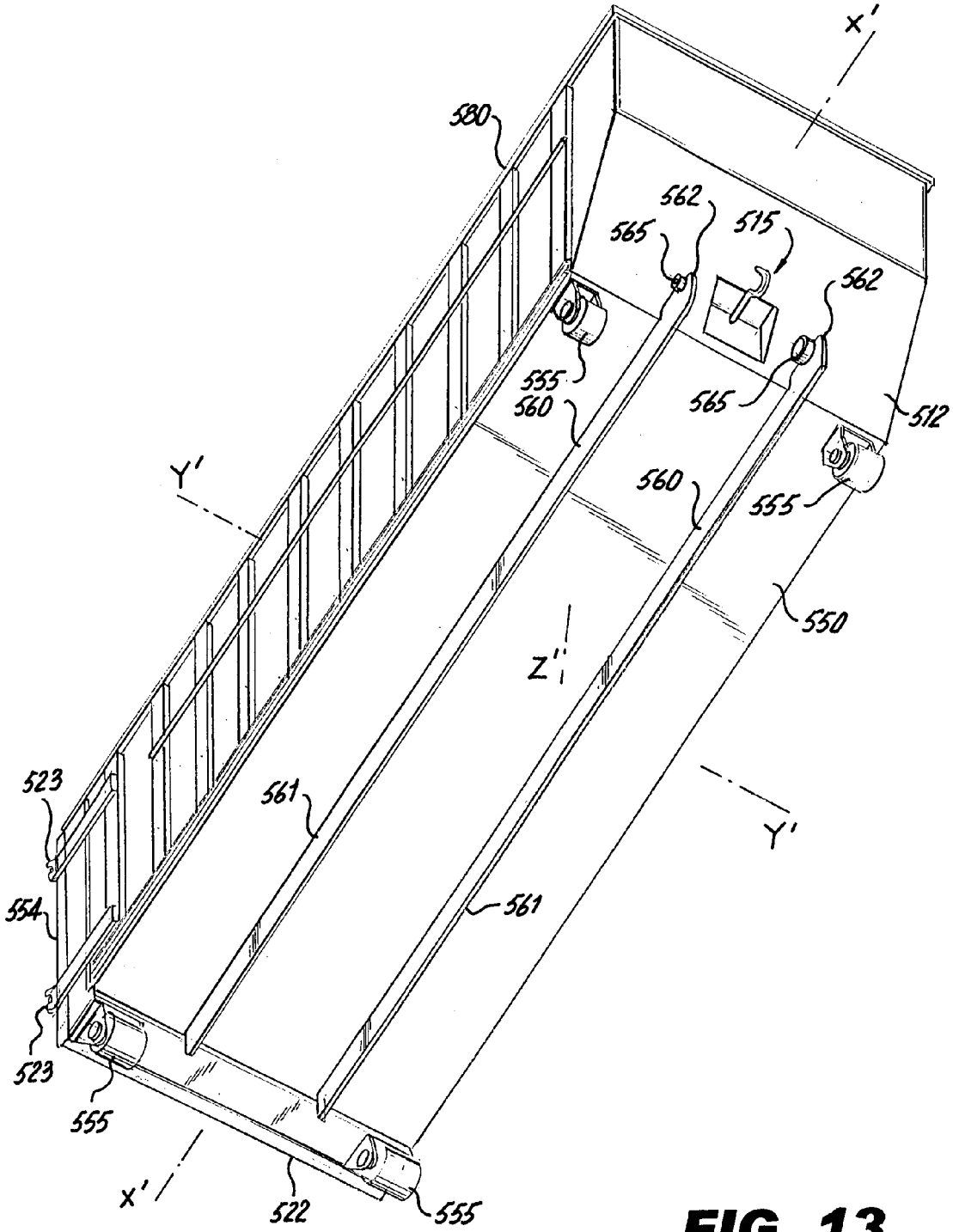
FIG. 13 is an exemplary bottom right front perspective view of the dumpster in FIG. 1, in accordance with the present invention.

Referring now to FIGS. 3 and 12–13, dumpster 500 has a front 510, a rear 520, a right side 530, a left side 540, and a bottom 550. Front 510, rear 520, right side 530, and left side 540 terminate or end in an upper edge 580. Upper edge 580 defines an opening 590 for the loading of matter into dumpster 500. Dumpster 500 defines axes X', Y', and Z' parallel with axes X, Y, and Z of truck 200 in a first position (See FIG. 2) such that, for example, sides 530 and 540 are parallel with plane X'-Z', front 510 and rear 520 are generally parallel with plane Y'-Z'. Thus, dumpster 500 is configured for alignment with ramp 310 and axis-X.

Front 510 includes a tapered portion 512 suitable for aiding in the loading and unloading of dumpster 500. Tapered portion 512 also extends over and accommodates room for winch 360 when truck 200 is in the first position.

Front 510 also includes connector 515 for connecting with winch 360. Connector 515 can be a recess having a bar, a loop or hook, positioned on tapered portion 512. Connector 515 in one preferred embodiment has a hook configured for engagement with terminal end 364 having a hole or loop. Alternatively, connector 515 can be configured as a cross member 517 suitable for engagement with cable terminal end 364 configured as a hook. Connector 515 when configured with a recess and bar, provides suitable access for hook 364 to securely engage cross member 517. Cross member 517 has suitable structural strength to be used for supporting the pulling and extending of loaded dumpster 500 by winch 360. Connector 515 configurations can also include a loop, wire, tow bar, chain, or another device suitable for fastening with means for loading and unloading dumpster 500.

Terminal end 364 can be configured for being disconnected manually by the user or by the user operating the remote control 100 from connector 515. The remote control disconnecting can be configured as being coupled with electronic system 240 or directly by a radio controlled signal from remote control device 100.

Rear 520 includes a pivotally mounted door 522. Door 522 is configured for rotating about a rear edge 554 of side 530 with an axis of rotation parallel to axis-Z'. Door 522 includes a pair of hinges 523 including an upper hinge and a lower hinge, but may include any kind of mechanism suitable for providing movement of door 522. A locking mechanism 524 has the structural integrity to securely retain door 522 in a closed position when loaded and when ramp 310 is in the second position. Locking mechanism 524 preferably includes an upper and a lower lock positioned on the opposing side to hinges 523.

Bottom 550 is configured to support the loading of dumpster 500 when detached from or positioned on truck 200 as well as the movement from and onto truck 200. In this one preferred embodiment bottom 500 has a roller 555 positioned in the vicinity of each bottom corner. Each of the rollers 555 has an axis of rotation that is parallel with axis-Y' and suitably configured for structurally supporting loaded dumpster 500, as well as supporting the rolling movement of dumpster 500 along axis-X'.

Bottom 550 also has two flanges or rails 560 parallel with axis-X'. Flanges 560 include a cantilevered portion 562 extending forward a bottom edge of tapered portion 522. Each cantilevered portion 562 includes a roller 565. Rollers 565 have an axis of rotation that is parallel with axis-Y' and configured for the supporting the rolling movement of dumpster 500 along axis-X'. Rollers 565 are preferably positioned on the inner side of each cantilevered portion 562, but can be positioned at any point along rails 560. Rails 560 are parallel with axis-X' and have a bottom edge 561 configured for interfacing with rollers 318 of ramp 310.

Dumpster 500 is preferably a metal or metal alloy, but it can be fabricated with any one or more materials such as a plastic, fiberglass, composite, or wood. Dumpster 500 in one preferred configuration is made substantially of sheet metal portions folded and joined together to form open topped dumpster 500. Portions of dumpster 500, such as sides 530 and 540, are reinforced with upper edge reinforcing and lower edge reinforcing. Aft rollers 555 are also positioned on a reinforcing bar on a rear edge of bottom 550 and parallel with axis-Y'.

Figure 14:
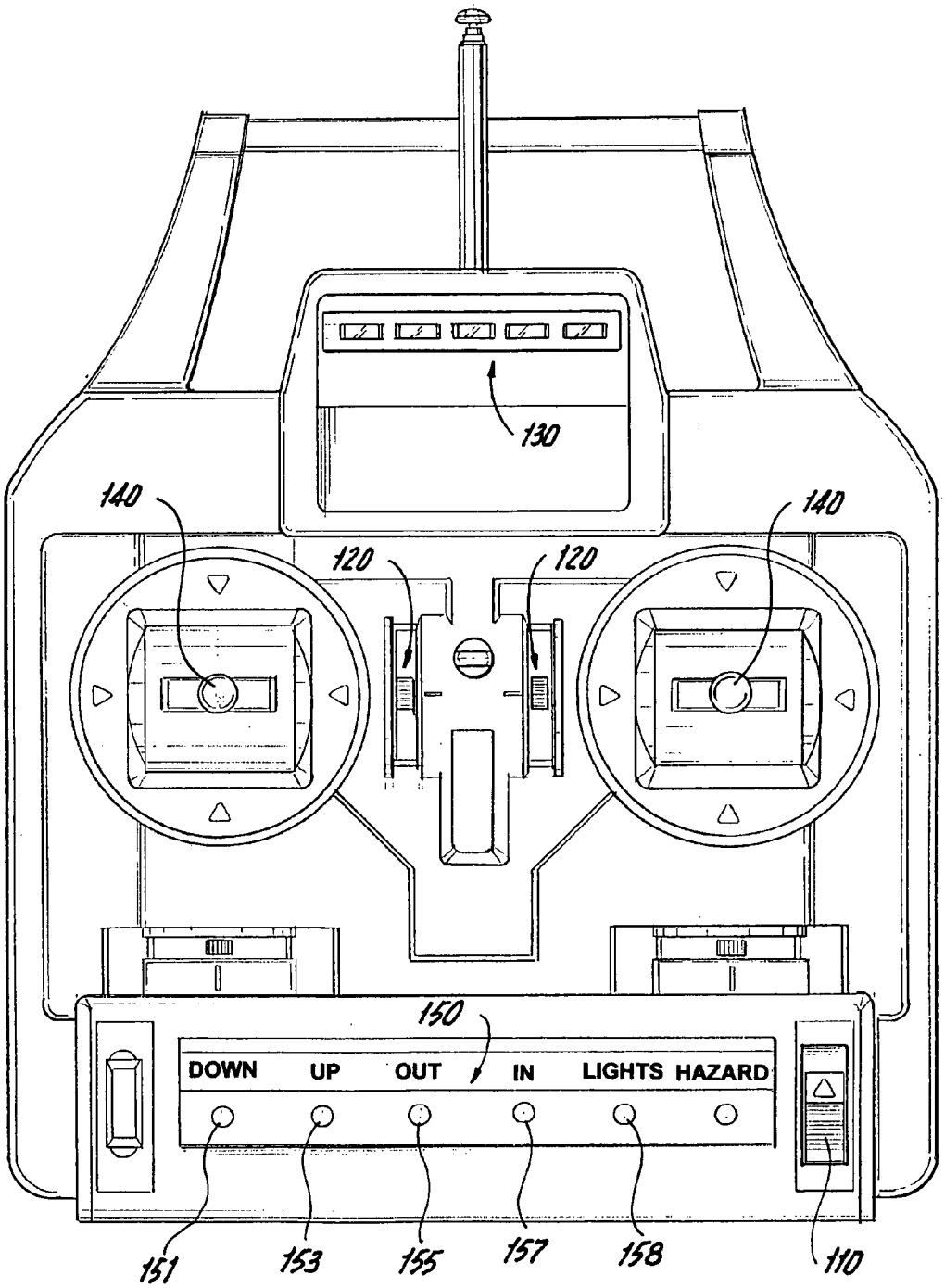
FIG. 14 is an exemplary remote control in FIG. 1, in accordance with the present invention.
Figure 15:
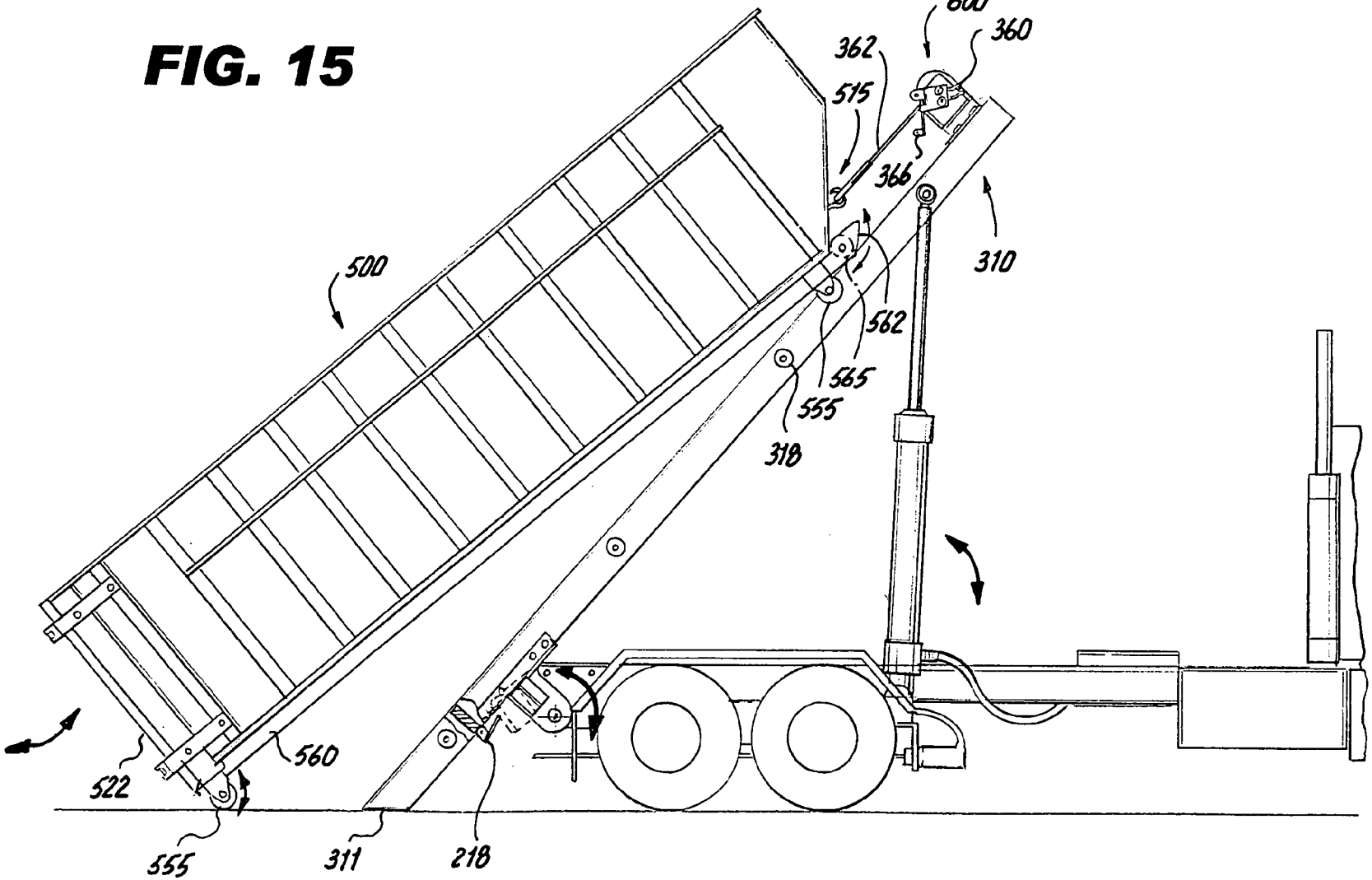
FIG. 15 is an exemplary side view of the truck in FIG. 1, with the ramp elevated and the dumpster at least partially positioned on the ramp, in accordance with the present invention.
Figures 16, 17:
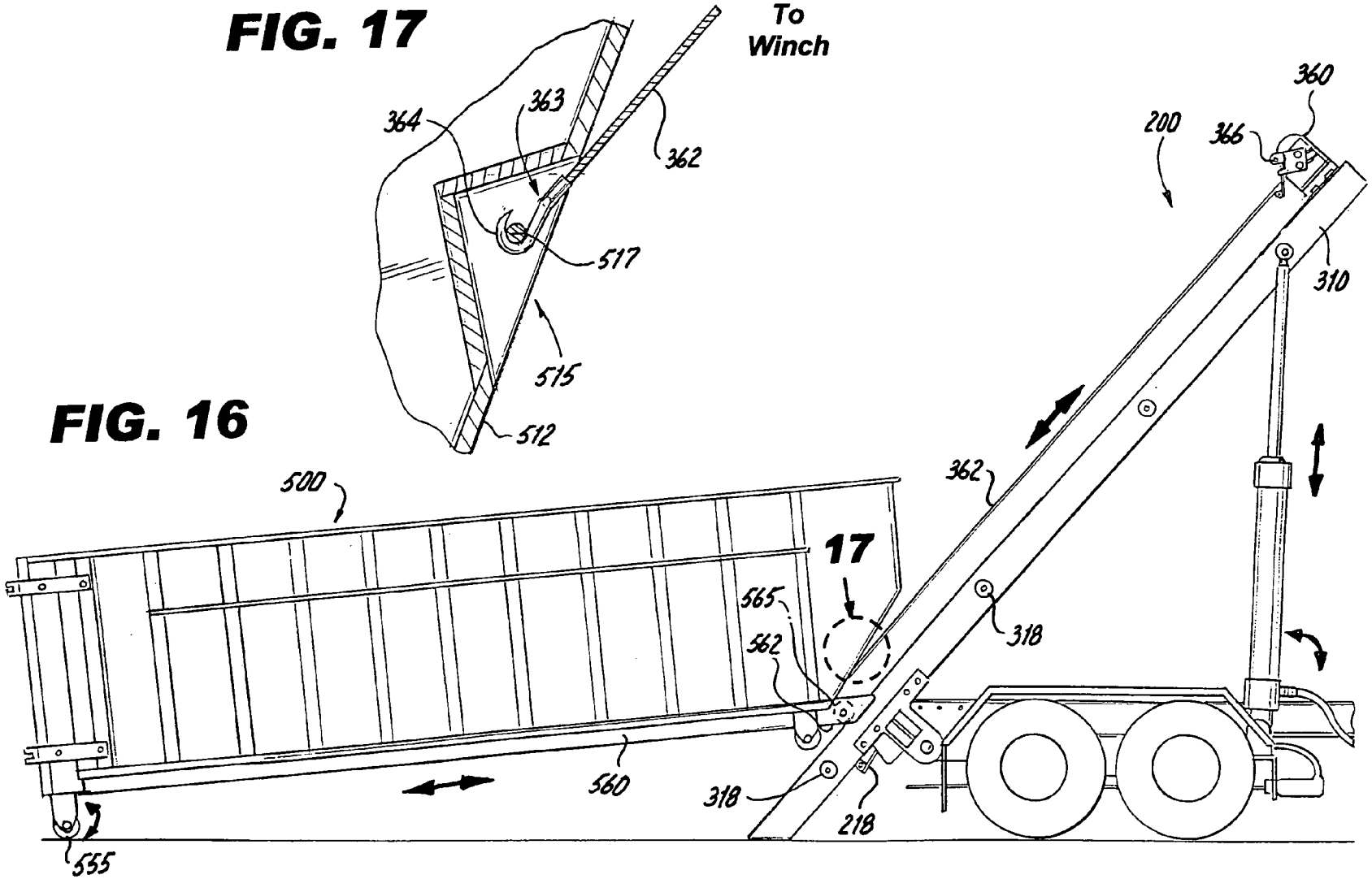
FIG. 16 is an exemplary perspective view of the right side of the truck in FIG. 1, with the ramp elevated and the dumpster substantially positioned on the ground, in accordance with the present invention.
FIG. 17 is an exemplary close up side view of one configuration of a terminal end of the cable connecting the winch to a bar on the dumpster, in accordance with the present invention.

As shown in FIGS. 1 and 14, remote control device 100 is a hand-held self-powered device providing controls suitable for the moving of truck 200 and the unloading and loading of dumpster 500. Remote control device 100 preferably is a standard commercially available remote control device that may be modified as required. Remote control device 100 comprises standard controls 150, including an on-off switch 110, amplification level devices 120, indicator lights for battery power 130, two joysticks 140, and an array of specialized switches 150. Joysticks 140 are configurable for multiple functions, such as the turning off and on of the horn as well as the selection of forward or reverse movement of truck 200. Joysticks 140 also have adjustable trims in the two axes of movement.

The array of specialized switches 150 includes controls for lowering ramp 310 using a down switch or "DN" 151 and elevating ramp 310 using an up switch or "UP" 153; extending cable 362, and, as appropriate, unloading dumpster 500 using winch 360 "OUT" 155; and retracting cable 362, and, as appropriate loading dumpster 500 using winch 360 using switch "IN" 157. Additional switches in array 150 include those for activating headlights 430 using switch "LIGHTS" 158 and hazard lights 440 using switch "HAZARD." Alternatively, the sound system may be selectable from array of specialized switches 150. Array of specialized switches may also include switches for remotely locking or unlocking cable terminal end 364 and/or means for connector 515.

In operation, as shown in FIGS. 1 and 3–4, roll-on roll-off remote control truck system 10 is initially positioned in the first position wherein dumpster 500 is positioned on ramp 310 (See FIGS. 1 and 3). Ramp 310 is in its lowermost position defined by the closing of the first limit switch and/or approximately abutting chassis 210. Front 510 of dumpster 500 is preferably in direct contact with and closes limit switch 366. Dumpster 500 is held in position by winch 360 and generally supported by the direct contact between rails 560 and the plurality of rollers 318 positioned on the outer side of rails 315 of ramp 310. Rollers 565, positioned on rails 560 in the vicinity of front end 510, are in contact with ramp 310.

Referring now to FIGS. 1, 5 and 14–19, using controls 250, electronic system 240 and other desired systems are powered by placing controls 250 in the "ON" position. Remote control 100 is also powered by placing the power switch 110 into the "ON" position. As necessary, truck 200 can be placed into the first position by activating remote control switch 151 "DOWN." Using remote control 100, truck 200 may be moved in a forward or reverse direction and directionally steered into a desired position using controls 140.

Truck 200 is moved from the first position to the second position by activating remote control specialized switch 153 "UP" to elevate ramp 310 and dumpster 500. Ramp 310 is pivoted upward from the first position in apposition with frame 220 to the second position. In the second position, front end 312 of ramp 310 has reached its desired elevation by releasing the "UP" switch or at a maximum elevation and when rear end 314 is in direct contact with limit switch 218 positioned on rear end 204. Dumpster 500 is retained by winch 360. The tapered edge of rear end 314 provides an easy transition for dumpster 500 from ramp 310 the ground surface. It is understood that the second position, as defined herein, may be any position between the first position and the position of maximum elevation that is suitable for the unloading of dumpster 500 in a particular application. In the second position, the position of dumpster 500 can range from being totally on ramp 310 to being substantially on ramp 310 and partially on the ground.

In the second position and preferably with dumpster 500 positioned solely on ramp 310, rear door 522 can be opened remotely or manually. The contents of dumpster 500 typically slide out of rear 520 by gravity but can be assisted by oscillating the elevation of ramp 310. Once the contents of dumpster 500 are removed, rear door 522 can be closed and secured by locking mechanism 524. Dumpster 500 positioned for traveling as necessary using winch 360 and then ramp 310 is lowered to the first position.

Truck 200 is moved from the second position by activating remote control switch 155 "OUT" such that winch 360 extends cable 362 and dumpster 500 is at least substantially on the ground. The force of gravity on dumpster 500 on ramp 310 results in dumpster 500 rolling and/or sliding down ramp 310 on the plurality of rollers 318. Rollers 555 are configured to contact the ground surface and enable dumpster 500 to roll partially off of ramp 310 into the third position wherein dumpster 500 is substantially unloaded from truck 200. Cable 362 may then be disconnected from means for connecting 515 on dumpster 500 remote or manually, as desired or configured when dumpster 500 is fully unloaded from truck 200 to the ground.

Truck 200 may then be moved separately from dumpster 500 with truck 200 in any position. Dumpster 500 may also be pulled using cable 232 by truck 200 while on the ground to a more desirable position. By activating the "DN" 151 and "UP" 153 switches on remote control 100, ramp 310 may be moved between the second position and the first position. When desired, truck 200 is returned to the vicinity of dumpster 500, ramp 310 is placed in an elevated position, and aligned therewith for loading.

Winch 360 also is used to position cable terminal end portion 363 such that terminal end 364 extends aft of the rear end of channel 322 and ramp rear end 314. Terminal end 364 is preferably remotely connected with connector 515 on dumpster 500 by maneuvering truck 200 and ramp 310 so as to align and engage connector 515 and terminal end 364. Connector 515 and cable terminal end 364 can be engaged manually or by remote control 100. Elevating ramp 310 lowers the position of ramp end 314 and terminal end 364 to accommodate terrain variations between truck 200 and connector 515 of dumpster 500. Ramp 310 with terminal end 364 extending beyond ramp end 314 is then raised and/or lowered to connect or disconnect terminal end 364 and connector 515. Once terminal end 364 and connector 515 are coupled together and truck 200 and dumpster 500 are aligned, ramp 310 is fully elevated in preparation for receiving dumpster 500.

Truck 200 is returned to the second position by activating remote control switch 157 "IN" to retract cable 362 of winch 360. Dumpster 500 is pulled by winch 360 into contact with and up ramp 310. Rollers 565 on flanges 560 are configured to initially impact and roll up rails 315 of ramp 310. As dumpster 500 is drawn up ramp 310 by winch 360, rollers 318 increasingly engage flanges 560. Rollers 555 positioned on bottom 550 rear corners are configured to provide the final points of contact with the ground surface as dumpster 500 transitions to being completely supported by ramp 310. Winch 360 continues to pull dumpster 500 up ramp 310 preferably until contact is made with limit switch 366 or switch 157 "IN" is inactivated.

Truck 200 is returned to the first position by activating the "DN" switch 151 on remote control 100 for the lowering of ramp 310 from the second position to the first position. Truck 200 is configured for the simultaneous movement of truck 200 while moving between the first and second positions. Additionally, the movement of truck 200 can be utilized to assist the unloading or loading of dumpster 500.

Although the illustrative embodiments of the present disclosure have been described herein with reference to the accompanying drawings, it is to be understood that the disclosure is not limited to those precise embodiments and that various other changes and modifications may be affected therein by one skilled in the art without departing from the scope or spirit from the disclosure. All such changes and modifications are intended to be included within the scope of the appended claims.

Having thus described my invention, what I claim as new, and desire to secure by Letters Patent is:

1. A remotely operated toy truck for loading and unloading a roll-on-roll-off dumpster, the truck comprising:

a dumpster system including a ramp for raising and lowering in relation to the truck, and a means for moving the dumpster between a loaded position on the ramp and an unloaded position off the ramp; and an electronic system for receiving one or more remote control signals to control the positioning of the ramp and the means to move the dumpster between the loaded position and the unloaded position.

2. The remotely operated toy truck according to claim 1, wherein the dumpster system further comprises a means for moving the ramp.

3. The remotely operated toy truck according to claim 2, wherein the means for moving the ramp comprises at least one reservoir, a pump and at least one piston, the pump providing fluid from the at least one reservoir under pressure to the at least one piston to raise and lower the ramp.

4. The remotely operated toy truck according to claim 1, wherein the means for moving the dumpster is a winch.

5. The remotely operated toy truck according to claim 4, wherein the winch is positioned on the ramp.

6. The remotely operated toy truck according to claim 4, wherein the winch includes a means for coupling to the dumpster.

7. The remotely operated toy truck according to claim 6, wherein the means for coupling to the dumpster is selected from the group consisting of: a loop; and a hook.

8. The remotely operated toy truck according to claim 1, wherein the dumpster includes a means for coupling to the means for moving the dumpster.

9. The remotely operated toy truck according to claim 8, wherein the means for coupling to the means for moving the dumpster is selected form the group consisting of: a hook; and a bar.

10. The remotely operated toy truck according to claim 1, wherein the ramp includes one or more limit switches to limit movement of the dumpster between the loaded position on the ramp and an unloaded position off the ramp.

11. A remotely operated toy truck for loading and unloading a roll-on-roll-off dumpster, the truck comprising:

a chassis;

a vehicular drive system disposed on the chassis and configured for moving the chassis on a plurality of tires;

a dumpster system disposed on the chassis, the dumpster system including a ramp for raising and lowering in relation to the chassis, and a means for moving the dumpster between a loaded position on the ramp and an unloaded position off the ramp; and an electronic system for receiving a plurality of control signals to control the vehicular drive system and the dumpster system, the electronic system controlling positioning of the ramp and the means to move the dumpster between the loaded position and the unloaded position.

12. The remotely operated toy truck according to claim 11, wherein the dumpster system further comprises a means for moving the ramp.

13. The remotely operated toy truck according to claim 12, wherein the means for moving the ramp comprises at least one reservoir, a pump and at least one piston, the pump providing fluid from the at least one reservoir under pressure to the at least one piston to raise and lower the ramp.

14. The remotely operated toy truck according to claim 11, wherein the means for moving the dumpster is a winch.

15. The remotely operated toy truck according to claim 14, wherein the winch is positioned on the ramp.

16. The remotely operated toy truck according to claim 15, wherein the winch includes a means for coupling to the dumpster.

17. The remotely operated toy truck according to claim 16, wherein the means for coupling to the dumpster is selected from the group consisting of: a loop; and a hook.

18. The remotely operated toy truck according to claim 11, wherein the dumpster includes a means for coupling to the means for moving the dumpster.

19. The remotely operated toy truck according to claim 18, wherein the means for coupling to the means for moving the dumpster is selected from the group consisting of: a hook; and a bar.

20. The remotely operated toy truck according to claim 11, wherein the ramp includes one or more limit switches to limit movement of the dumpster between the loaded position on the ramp and an unloaded position off the ramp.

* * * * *